US007601232B2

(12) United States Patent
Fonte et al.

(10) Patent No.: US 7,601,232 B2
(45) Date of Patent: Oct. 13, 2009

(54) α-β TITANIUM ALLOY TUBES AND METHODS OF FLOWFORMING THE SAME

(75) Inventors: Matthew V. Fonte, Charlestown, MA (US); John F. Heymans, Salem, NH (US); George L. Durfee, Grafton, MA (US)

(73) Assignee: Dynamic Flowform Corp., Billerica, MA (US)

( * ) Notice: Subject to any disclaimer, the term of this patent is extended or adjusted under 35 U.S.C. 154(b) by 620 days.

(21) Appl. No.: 11/004,629

(22) Filed: Dec. 3, 2004

(65) Prior Publication Data

US 2006/0070688 A1 Apr. 6, 2006

Related U.S. Application Data

(60) Provisional application No. 60/615,264, filed on Oct. 1, 2004.

(51) Int. Cl.
*C22F 1/06* (2006.01)

(52) U.S. Cl. ..... 148/670; 72/343

(58) Field of Classification Search ..... 148/501, 148/535, 671, 670; 72/343
See application file for complete search history.

(56) References Cited

U.S. PATENT DOCUMENTS 3,969,155 A * 7/1976 McKeighen ..... 148/671
4,482,398 A * 11/1984 Eylon et al. ..... 148/501
2004/0173465 A1* 9/2004 Burca et al. ..... 205/171

OTHER PUBLICATIONS

Klocke, F., et al., "Laser-Assisted Metal Spinning of Advanced Materials," *Fraunhofer Institute of Production Technology IPT*, pp. 1-5.
Chang, O.W., "Zirconium and Titanium Flowformed Products Offer Myriad of Advantages," *Outlook*, 1st Quarter, 1999.
Fonte, V., "Flowforming of Thin-Walled Tubes and Cylinders," *Dynamic Machine Works, Inc.*
Scutti, J. J., "Flowformed Titanium Tubular Products," *Advanced Materials & Processes*, Jan. 2001.
Koch, M., et al., "Seamless Thin-Walled TiA16V4 Tubes Manufactured by Flow-Forming Process," *Titanium Science and Technology*, 1993, pp. 1429-1436.
Statement regarding prior activities of Dynamic Machine Works, Inc.
Klocke, F., et al., "Laser-Assisted Metal Spinning of Advanced Materials," *Fraunhofer Institute of Production Technology IPT*, pp. 1-5, 2003.
Fonte, V., "Flowforming of Thin-Walled Tubes and Cylinders," *Dynamic Machine Works, Inc.*, 2001.
Statement regarding prior activities of Dynamic Machine Works, Inc., Oct. 19, 2005.

* cited by examiner

*Primary Examiner*—Roy King
*Assistant Examiner*—Weiping Zhu
(74) *Attorney, Agent, or Firm*—Sunstein Kann Murphy & Timbers LLP

(57) ABSTRACT

Described herein are methods for forming titanium alloy tubes having an α-β grain structure. The methods include the steps of hot-working a titanium alloy workpiece at a temperature below the β-transus temperature of the workpiece and above the recrystallization temperature of the workpiece to produce an α-β titanium alloy preform hollow. Subsequently, the α-β titanium alloy preform hollow is flowformed, thereby forming a α-β titanium alloy tube.

39 Claims, 5 Drawing Sheets

α-β TITANIUM ALLOY TUBES AND METHODS OF FLOWFORMING THE SAME

RELATED APPLICATION

This application claims the benefit of U.S. Provisional Application No. 60/615,264, filed on Oct. 1, 2004. The entire teachings of this Provisional application are incorporated herein by reference.

BACKGROUND OF THE INVENTION

Flowforming is an advanced forming process for the manufacture of hollow components that allows for the production of dimensionally precise and rotationally symmetrical metallic components. In production, flowforming processes are conducted at temperatures below the recrystallization temperature of the metal being flowformed. In other words, flowforming is usually a cold-forming process.

Subjecting a portion of metal to a flowforming process typically requires that the metal first be formed into a hollow preform that will fit onto the flowforming mandrel. Once fitted on the mandrel, the preform is then subjected to the flowforming process and shaped by compression with one or more hydraulically driven rollers applied to the outside diameter of the preform. To date, over fifty different types of metal and metal alloys have been successfully flowformed. To date, however, flowforming certain types of titanium alloys has not been possible at temperatures below the re-crystallization temperature.

Titanium can exist in two crystallographic forms. At room temperature, titanium has a hexagonal close-packed crystal (hcp) crystal structure, known as "alpha" phase (α phase). At around 883° C. (~1,621° F.), the α phase transforms to a body-centered cubic (bcc) crystal structure, called "beta" phase (β phase). In titanium alloys, both the α and β phases may coexist over a range of temperatures. The lowest temperature at which a titanium or titanium alloy is completely converted to the β phase is known as the beta transus (β-transus).

Titanium alloying elements can raise or lower the β-transus temperature, and the elements are often classified based upon how they affect the β-transus temperature. "Alpha stabilizers" (α stabilizers; e.g., aluminum, carbon, gallium, germanium, nitrogen, and oxygen) tend to increase the temperatures where the α phase is stable, while "beta stabilizers" (β stabilizers; e.g., nickel, molybdenum, and vanadium) tend to suppress the β-transus temperature thereby allowing the β phase to remain stable at lower temperatures.

In discussing the metallurgy of titanium, it is common to separate titanium alloys into five categories, referring to the common phases present: alpha alloys (α alloys), near-alpha alloys (near-α or superalpha alloys), alpha-beta alloys (α-β alloys), near-beta alloys (near-βalloys), and beta alloys (β alloys). These alloy categories describe the origin of the microstructure in terms of the basic crystal structure favored by an alloy composition.

At temperatures below the β-transus temperature, an a alloy has no β phase. A near-α alloy generally includes only limited β phase at temperatures below the β-transus, and so it may appear microstructurally similar to an α alloy at lower temperatures, while an α-β alloy will include both an alpha phase and a retained or transformed beta phase. Both near-β alloys or β alloys tend to retain the β phase on initial cooling to room temperature.

α-β alloys are heat treatable to varying extents and most are weldable with the risk of some loss of ductility in the weld area. These are generally medium to high strength materials with tensile strengths generally in the range of from about 120,000 psi (~830 MPa) to about 181,000 psi (~1250 MPa) and with useful creep resistance up to about 350 to 400° C. Hot forming qualities are generally good, but traditionally the α-β alloys could not be readily formed at room temperature. The α-β alloys have high yield point to tensile strength ratios, usually over 90%, resulting in a very high strength with limited ductility.

This low ductility or low elongation limits the α-β alloy's plastic formability to a very narrow range, rendering α-β alloys unsuitable for use in many traditional cold-forming processes (e.g., flowforming). For example, M. Koch, et al. were able to produced seamless Ti6Al-4V titanium tubes using a flow-forming process only by conducting the flow-forming process at temperatures above the recrystallization temperature of the titanium alloy. This procedure for flow-forming at temperatures above the recrystallization temperature is not economical or practical because the hot temperature damages equipment. Also, this high-temperature flow-forming process is not capable of producing dimensionally precise tubes. The higher high-temperature flow-forming process demands that the tube being flowformed have relatively thick walls. Also, the tubes undergo significant dimensional changes as they are cooled to room temperature. Additional processing (e.g., secondary machining) is needed to produce the desired shape and/or dimensions.

In the past, flowforming α-β titanium tubes has been problematic or impossible, with the α-β titanium preforms consistently cracking during the flowforming processes. Because of this, flowforming processes have not been an acceptable manufacturing method of producing α-β titanium alloys. A need exists in the art for new methods that allow flowforming of α-β titanium alloys.

SUMMARY OF THE INVENTION

This invention features methods of flowforming α-β titanium alloy tubes. In some embodiments, the methods comprise the steps of producing an α-β titanium alloy preform hollow or tube by hot-working a titanium alloy workpiece at a temperature below the β-transus temperature of the workpiece and above the recrystallization temperature of the workpiece and subsequently flowforming the preform hollow at a temperature below the recrystallization temperature of the hollow.

This invention provides methods that can be used to flowform α-β titanium alloy tubes at low temperatures (e.g., below the alloy's recrystallization temperature). Using these methods, the tubes can be produced more consistently because the flowforming step forms usable tubes to a net shape or a near net shape. This provides for increased economic value by reducing material waste and labor expenses, such as the labor expenses associated with secondary machining, grinding, and honing operations that may be required to bring the tube into dimensional specifications.

The methods of this invention produce titanium alloy tubes having metallurgical advantages. For example, tubes produced by this method have grains that are reduced or "refined" in cross-sectional area in a plane perpendicular to the longitudinal axis and elongated in the axial direction (i.e., parallel to the center line of the tube). This refined and realigned grain structure is surprisingly uniform both circumferentially and through the entire length of the flowformed part, making the tube very stable. The refinement and uniformity of the grain structure helps to maintain significant ductility, which is usually lost during traditional cold forming processes. Also, tubes produced by this invention display increased mechanical properties, such as increased longitudinal and circumferential yield and tensile strengths. The combination of increased mechanical properties and the retention of significant ductility make this invention very unique and advantageous.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
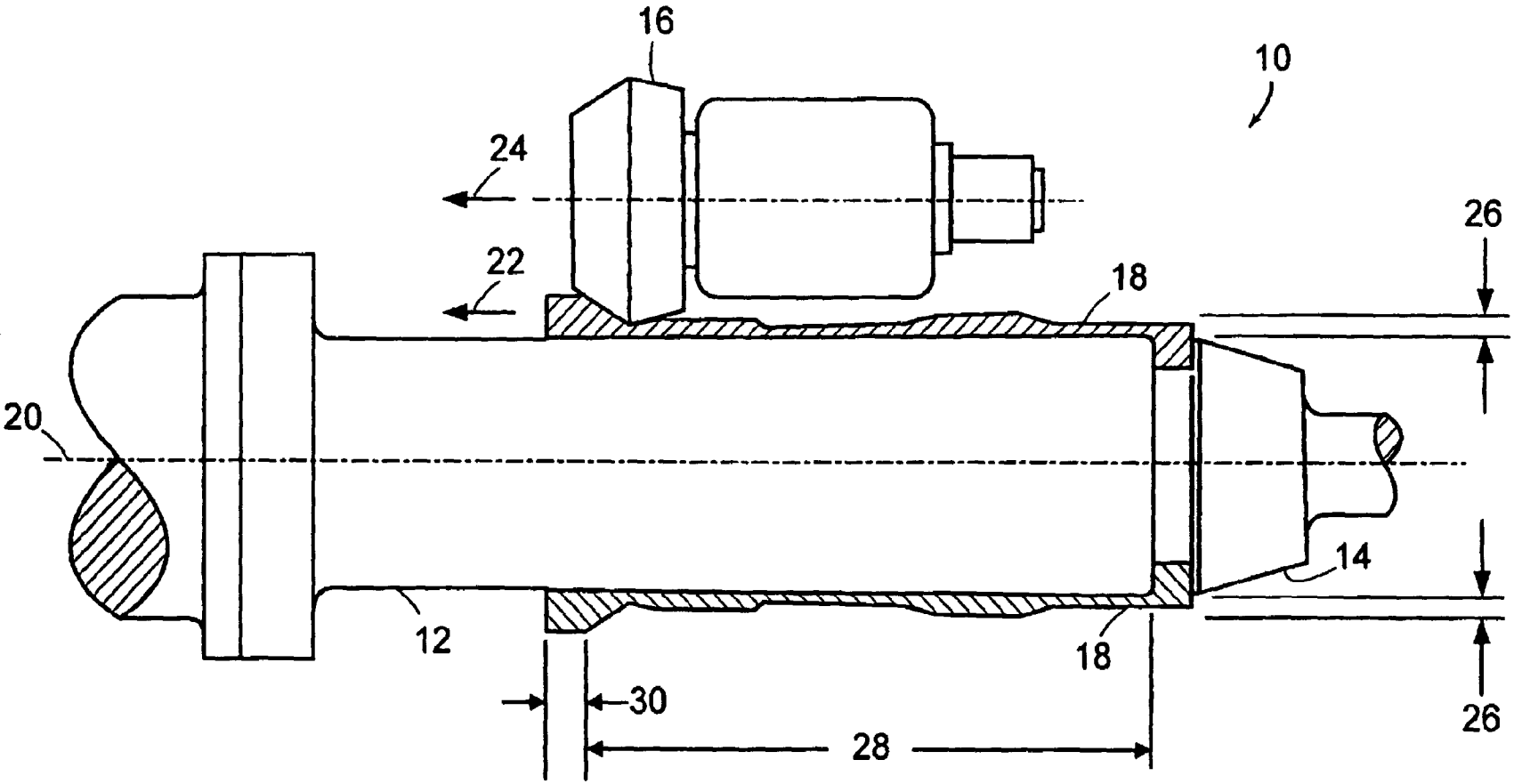
FIG. 1 illustrates a schematic diagram showing a side-view of an exemplary forward flowforming device.

A description of preferred embodiments of the invention follows. While this invention has been particularly shown and described with references to preferred embodiments thereof, it will be understood by those skilled in the art that various changes in form and details may be made therein without departing from the scope of the invention encompassed by the appended claims.

In order to subject a metal to a flowforming process, the metal must first be fashioned into a suitable preform shape so it can be mounted onto the flowforming mandrel. It has been surprisingly discovered that the phase structure and/or the grain structure of a titanium alloy is important in preventing the occurrence of cracks and other imperfections during a subsequent flowforming process. For example, maintaining or creating an α-β phase structure in a titanium alloy preform can reduce the occurrence of cracks and allows the preform to be successfully flowformed. In addition, or alternatively, it is believed that reducing or refining the size of the grain structure of an α-β titanium alloy is important to reducing the occurrence of cracks and allows the α-β titanium alloy to be successfully flowformed.

It has not been previously recognized that the past attempts to flowform α-β alloys involved steps and processes that resulted in a grain structure and/or phase structure within a titanium alloy that would accommodate a flowforming process. Specifically, the processes used to make the flowforming preform hollow tended to be conducted at high temperatures (e.g., 2,000° Fahrenheit or more) for a variety of reasons. For example, those of skill in the art chose to conduct those processes at these hotter temperatures because it reduced stress on the equipment and dies used in various metal working processes (e.g., extrusion, forging, and rolling processes).

When the flowform preform hollow is produced using processes conducted at too high of a temperature (e.g., above the β-transus temperature), the processes actually causes the metal of the preform to shift or change phases from a crystallographic structure made of a mixture of α-β phases to a more predominantly β phase crystallographic structure. In addition, or alternatively, the processes used to make a flowforming preform resulted in a preform having a grain structure that was too coarse for subsequent flowforming processes. It is believed that this phase change and/or grain structure is detrimental during flowforming processes, causing the preform to crack.

The microstructure of titanium alloys is affected by hot-working or plastic deforming the titanium alloy workpiece at elevated temperatures. If the titanium alloy workpiece is heated above the β-transus temperature during the hot-working operation, upon cooling to room temperature, the microstructure will exhibit only "transformed beta" grains without any grains of "primary alpha." If the hot-working is accomplished within the temperature range wherein both α and β phases are stable (e.g., at a temperature between the recrystallization and β-transus temperatures), the resulting microstructure will exhibit a mixture of primary a and transformed β phases. It has been surprisingly discovered that a titanium alloy hot-worked at temperatures between the recrystallization and β-transus temperatures can be successfully flowformed at room temperature.

This invention provides methods of flowforming α-β titanium alloys. The methods allow for the successful flowforming of α-β titanium alloys by maintaining or creating an α-β phase structure in the titanium preform, thereby providing for better flowforming performance. Alternatively, or in addition to, the methods of this invention also produce an α-β titanium alloy preform that has a grain structure with refined and/or reduced grain size, thereby providing for better flowforming performance.

This invention features methods of forming an α-β titanium alloy tube. In some embodiments, the methods comprise the steps of hot-working a titanium alloy workpiece at a temperature below the β-transus temperature of the workpiece and above the recrystallization temperature of the workpiece to produce an α-β titanium alloy preform hollow or tube. The α-β preform hollow is then flowformed at a temperature below the recrystallization temperature or the preform hollow, thereby forming an α-β titanium tube.

Forming a Metal Preform

The methods of the present invention include the preparatory step of producing a titanium alloy preform hollow or tube having an α-β phase structure by hot-working a titanium alloy workpiece at a temperature below the β-transus temperature of the workpiece and above the recrystallization temperature of the workpiece. Hot working at this temperature range provides a preform that has an α-β phase structure and/or a finer grain structure. The β-transus temperature is dependent on the composition of the titanium alloy being worked, but generally is around ~1800° F. As used herein, a "workpiece" is a titanium alloy that is not yet completed the hot-working steps of the present invention. As used herein, a "preform" refers to a workpiece which has completed the hot-working process of the present invention.

By hot working a titanium alloy workpiece at a temperature below the β-transus, the titanium alloy can be imparted with an α-β phase structure or an α-β phase structure can be maintained during formation of a preform. In some embodiments, the metal workpiece includes a titanium alloy, and the hot working step imparts or creates an α-β phase structure within the titanium alloy of the workpiece. For example, the titanium could be a near-β alloy having metastable beta phase crystals. During hot working below the β-transus, some of the metastable beta phase crystal transforms into alpha phase crystals, thereby producing an α-β phase structure in the titanium alloy workpiece. In other embodiments, the metal workpiece includes an α-β titanium alloy, and the step of hot working is conducted at a temperature below the β-transus to ensure that the phase structure maintains an α-β phase structure, while helping to refine the existing α-β phase structure that was initially in the work piece.

For α-β alloys, the hot working step produces a preform having a microstructure comprising primary alpha phase interspersed with areas of transformed β phase. The exact proportion of alpha phase to beta phase that must be produced within the workpiece in order to provide an α-β preform suitable for flowforming depends on the needs of the flowforming process in question, the requirements of the given application, and the composition of the titanium alloy being hot worked. It is believed that at least 5% by volume of the preform must be in the alpha phase (with the balance being beta phase) in order to sufficiently reduce the likelihood that the resulting preform hollow will be deleteriously altered during the flowforming step. Preferably, the workpiece is hot worked until at least 10% of the titanium, by volume, is in the alpha phase. More preferably, the workpiece is hot worked until at least 15% of the titanium, by volume, is in the alpha phase. Even more preferably, the workpiece is hot worked until at least 25% of the titanium, by volume, is in the alpha phase. Most preferably, the workpiece is hot worked until at least 30% of the titanium, by volume, is in the alpha phase.

The metal workpiece is formed of a titanium alloy, and the hot working step refines the grain structure or size of the grains within the titanium alloy. This is accomplished by hot working the workpiece at temperatures between the alloy's recrystallization and β-transus temperatures, thereby allowing the grains in the titanium alloy to become refined and/or more uniform. It is believed that this refined and/or more uniform grain structure in the resulting preform provides for improved flowforming performance.

The exact grain structure necessary to render a workpiece suitable for use as an α-β preform depends on the needs of the flowforming process in question, the requirements of the given application, and the type of titanium alloy comprising the workpiece. Generally, the larger the amount of wall deformation during the hot working process, the finer the resulting grain structure is in the preform. In some embodiments, the workpiece is sufficiently hot worked so that the resulting preform has an average grain size of 1 or finer, according to ASTM E112 standards. In further embodiments, the workpiece is sufficiently hot worked so that the resulting preform has an average grain size of 2 or finer on the ASTM E112 scale. Preferably, the workpiece is sufficiently hot worked so that the resulting preform has an average grain size of 4 or finer on the ASTM E112 scale.

The workpieces are formed of a titanium alloy. In some embodiments, the titanium alloy includes aluminum, carbon, cobalt, chromium, copper, gallium, germanium, hydrogen, iron, manganese, molybdenum, nickel, nitrogen, oxygen, silicon, tin, vanadium, zirconium, or mixtures thereof.

In some embodiments, the workpiece is formed of one of the α-β titanium alloys Ti-6Al-4V (i.e., a titanium alloy that includes about 6% by weight aluminum and about 4% by weight vanadium; also referred to as "grade 5" titanium alloy), Ti-6Al-4V ELI (i.e., a titanium alloy that includes about 6% by weight aluminum and about 4% by weight vanadium and has an oxygen content of less than about 0.13% by weight; also referred to as "grade 23" titanium alloy), Ti-3Al-2.5V (i.e., a titanium alloy that includes about 3% by weight aluminum and about 2.5% by weight vanadium; also referred to as "Grade 9"), Ti-6Al-2Sn-4Zr-2Mo (i.e., a titanium alloy that includes about 6% by weight aluminum, about 2% by weight tin, about 4% by weight zirconium, and about 2% by weight molybdenum), Ti-6Al-2Sn-4Zr-6Mo (i.e., a titanium alloy that includes about 6% by weight aluminum, about 2% by weight tin, about 4% by weight zirconium, and about 6% by weight molybdenum), or Ti-4Al-2.5V (i.e., a titanium alloy that includes about 4% by weight aluminum and about 2.5% by weight vanadium), or other α-β titanium alloys known in the art.

As known to those of skill in the art, a "hot-working" process is defined as a process that causes plastic deformation of metal at temperatures sufficiently high so as to not create strain hardening within the hot worked metal or metal alloy. The lower temperature limit for a "hot-working" process is the recrystallization temperature. As used herein, "hot-working" and references to "hot-working" processes, methods, or tools refer to the numerous processes that cause plastic deformation of metal at a temperature sufficiently high not to create strain hardening, with the proviso that "hot-working" and "hot-working processes" do not include or refer to those forging processes that are known in the art as "backward forging" or "back forging" processes. A "back forging" process is a metal forging process where a workpiece is struck by a punch and the workpiece is forced to back flow in the die or cavity in the opposite direction of the punch, resulting in a zero degree draft on vertical walls.

Examples of suitable hot-working processes used to form the α-β titanium alloy preform hollow include casting processes, cogging processes, extrusion processes, forging processes (with the proviso that the forging processes do not include back forging processes), piercing processes, pilgering processes (tube reducing processes), pressing processes, rolling processes, and/or swaging processes.

Examples of specific types of extrusion processes suitable for forming an α-β titanium preform hollow include backward extrusion processes, direct extrusion processes, forward extrusion processes, impact extrusion processes, and indirect extrusion processes. In some embodiments of the invention, the step of forming the α-β titanium alloy preform hollow includes extruding a metal that is in the form of a bar, a billet, a consolidated metal powder, or a metal casting.

Examples of specific types of forging processes suitable for forming an α-β titanium preform hollow include closed die forging processes, counterblow forging processes, drop forging processes, hammer forging processes, high-energy-rate forging processes, hollow forging processes, hot forging processes, hot-die forging processes, isothermal forging processes, near-net-shape forging processes, open die forging processes, press forging processes, roll forging processes, saddle/mandrel forging processes, swaging forging processes that use a semicontoured die, and/or upset forging processes.

In some embodiments, the step of producing an α-β titanium preform hollow includes machining a hot-rolled bar or billet.

One example of a piercing process suitable for forming an α-β titanium preform hollow is a rotary-piercing process. In some embodiments, the step of forming a metal preform hollow having an α-β grain structure includes rotary-piercing an existing metal preform.

In some embodiments, the step of producing an α-β titanium preform hollow includes hot isostatic pressing at least a portion of metal powder.

Examples of specific types of rolling processes suitable for forming an α-β titanium preform hollow include bar rolling processes, plate rolling processes (i.e., a process where a thick slab is rolled into a plate or sheet), and/or ring rolling processes. A plate rolling processes is one where a thick slab is rolled into a plate or sheet. Then a rolling or break forming process can be used to shape the plate or sheet into a tube and the edges can be welded to produce the desired integral tube shape.

In some embodiments, the step of forming an α-β titanium preform hollow includes at least one hot swaging or GFM process which reduce the size of a forging stock.

In some embodiments, the hot-working process also shapes the preform into a tube. In other embodiments, the hot-working process produces or maintains the α-β phase structure of the metal preform, while one or more separate processes are used to shape or form the preform into a tube or hollow. For example, in some embodiments, the metal workpiece is subjected to a hot working process to form the α-β phase structure or a portion of the α-β phase structure, and the metal workpiece is also subjected to a process (e.g., a machining process) in order to produce the metal preform hollow. In some embodiments, the hot working process precedes the process used to form the tubular shape. In other embodiments, the hot working process is preceded by a process used to form the tubular shape. In still further embodiments, a combination of one or more hot working processes interspersed with one or more processes used to form the tubular shape is used to form a metal preform hollow having an α-β phase structure.

In various embodiments, the metal preform hollow that is produced has two open ends. In other embodiments, the metal preform hollow that is produces has one open end and one closed or partially closed end.

In some embodiments, the metal preform hollow that comprises α-β titanium clad with a second different metal. For example, the outer inner surfaces of the metal preform hollow can be clad with a metal that can be flowformed.

Flowforming the α-β Titanium Preform Hollow

The methods of the present invention also comprise a step of flowforming an α-βtitanium preform hollow, thereby forming a metallic tube that includes α-β titanium. Flowforming is an advanced forming process for the manufacture of hollow components that allows for the production of dimensionally precise and rotationally symmetrical components and is typically performed by compressing the outside diameter of a cylindrical component or preform using a combination of axial and radial forces from one or more rollers. The metal is compressed and plasticized above its yield strength and made to flow by displacement in the axial direction onto a mandrel. The workpiece being formed, the rollers, and/or the mandrel can rotate. Two examples of flowforming methods are forward flowforming and reverse flowforming. Generally, forward flowforming is useful for forming tubes or components having at least one closed or semi-closed end (e.g., a closed cylinder). In forward flowforming, the bottom of the preform is clamped to a mandrel with a tailstock, and the preform rotates with the mandrel. Reverse flowforming is generally useful for forming tubes or components that have two open ends (e.g., a tube having two open ends). In reverse flowforming, a drive-ring is used to rotate the preform on a mandrel.

FIG. 1 illustrates a schematic diagram showing a side-view of exemplary forward flowforming device 10. Device 10 includes mandrel 12, tailstock 14, and roller 16. In some embodiments, a flowforming device includes more than one roller is used (e.g., two or three rollers). Preform 18 is a metal or metal alloy tube or hollow cylinder having one open end and one semi-open or closed end.

In operation, preform 18 is placed over mandrel 12. Mandrel 12 rotates about major axis 20. Tailstock 14 applies an amount of force or pressure to preform 18 to cause the preform to rotate with mandrel 12. As mandrel 12 and preform 18 rotate, roller 16 is moved into a position so that it contacts the outer surface of preform 18 at a desired point along the length of the preform. Roller 16 compresses the outer surface of preform 18 with enough force so that the metal of the preform is plasticized and caused to flow by displacement in direction 22, generally parallel to axis 20. Roller 16 can be positioned at any desired distance from the outer diameter of mandrel 12 or the inner wall of preform 18, thereby compressing the walls of the preform to any desired thickness at the point of compression. For example, the walls of preform 18 can be compressed to width 26 at a point of compression.

While mandrel 12 and preform 18 continue to rotate, roller 16 is moved down the length of preform 18, generally in direction 24, thereby compressing additional portions of the length of preform 18 to a desired thickness. As it moves down the length of preform 18, roller 16 can be positioned at different distances relative to mandrel 12 or it can be kept at the same distance relative to mandrel 12. As the roller(s) move(s) down the length of a preform, the roller(s) deform(s) the preform into a metal or metal alloy tube having walls with a desired thickness or thicknesses. In FIG. 1, length 28 represents the portion of the preform that has been formed into the metal tube. Length 30 represents additional portions of the preform that have yet to be formed. This operation is termed "forward flowforming" because the deformed material flows in the same direction that the rollers are moving.

Figure 2:
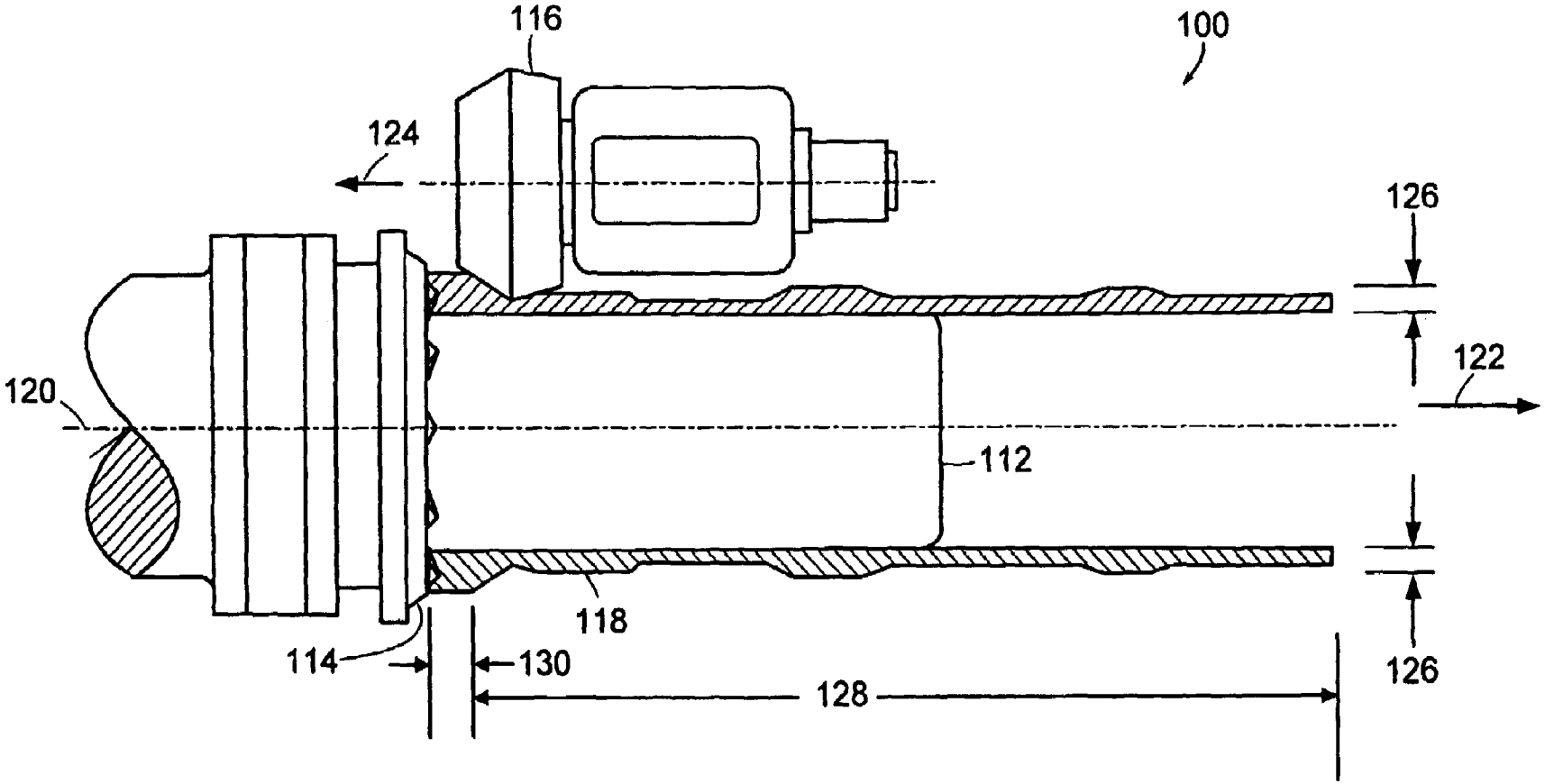
FIG. 2 illustrates a schematic diagram showing a side-view of an exemplary reverse flowforming device.

FIG. 2 illustrates a schematic diagram showing a side-view of exemplary reverse flowforming device 100. Device 100 includes mandrel 112, drive ring 114, and roller 116. In some embodiments, a flowforming device includes more than one roller is used (e.g., two or three rollers). Preform 118 is a metal or metal alloy tube or hollow cylinder having two open ends.

In operation, preform 118 is placed over mandrel 112 and pushed against drive ring 114. Mandrel 112 rotates about major axis 120. As mandrel 112 rotates, roller 116 is moved into a position so that it contacts the outer surface of preform 118 at a desired point along the length of the preform. Roller 116 presses preform 118 against drive ring 114, thereby causing preform 118 to rotate with mandrel 112. Drive ring 114 has a series of protruding splines on its face or other means for securing preform 118 so that it will rotate with mandrel 112. Roller 116 compresses the outer surface of preform 118 with enough force so that the metal of the preform is plasticized and caused to flow under roller 116 and in direction 122, generally parallel to axis 120. Roller 116 can be positioned at any desired distance from the outer diameter of mandrel 112 or the inner wall of preform 118, thereby compressing the walls of the preform to any desired thickness at the point of compression. For example, the walls of preform 118 can be compressed to width 126 at a point of compression.

While mandrel 112 and preform 118 continue to rotate, roller 116 is moved down the length of preform 118, generally in direction 124, thereby compressing additional portions of the length of preform 118 to a desired thickness or thicknesses. As the roller(s) move(s) down the length of a preform, the roller(s) deform(s) the preform into a metal or metal alloy tube having walls with any desired thickness. In FIG. 2, length 128 represents the portion of the preform that has been formed into the metal tube. Length 130 represents additional portions of the preform that have yet to be formed. As the tube is formed, it is extended down the length of the mandrel opposite from drive ring 114. This operation is termed "reverse flowforming" because the deformed material flows in the opposite direction as the rollers are moving.

A preform may be subjected to one or more (e.g., at least two, three, four, five, or more than five) flowforming passes, with each flowforming pass compressing the walls of the preform or some portion of the walls of the preform into a desired shape or desired thickness. In some embodiments, one, more than one, or all of the flowforming passes are conducted at or below a temperature (e.g., at ambient or room temperature) below the recrystallization temperature of the hollow preform. In other embodiments, a fraction of the flowforming passes are conducted at a temperature above the recrystallization temperature of the hollow preform.

In some embodiments, the α-β titanium tube that is formed has one open end, with the other end being closed or partially closed. In other embodiments, both ends of the formed α-β titanium tube are open.

In a preferred embodiment, the α-β titanium preform hollow that is formed is devoid of seams or substantially devoid of seams.

The α-β titanium tube that is formed can be in any desired size or shape and is limited only by the physical and mechanical constraints of the flowforming machine. The α-β titanium tube can be any desired length. For example, the α-β titanium tube can be about 30 feet (~9.14 meters) or more in length, about 30 feet (~9.14 meters) or less in length, about 20 feet (~6.1 meters) or less in length, about 10 feet (~3.05 meters) or less in length, about 24 inches (~0.61 meters) or less in length, about 12 inches (~0.305 meters) or less in length, or about 6 inches (~0.152 meters) or less in length.

The formed α-β titanium tube can have any desired wall thickness (i.e., the distance between the inner and outer surfaces of the tube or the distance between the inner and outer diameters of the tube at a point along the length of the metallic tube). For example, the α-β titanium tube can have a wall thickness of about 0.750 inches (~19.05 millimeters) or less, between about 0.250 inches (~6.35 millimeters) and about 0.5 (~12.7 millimeters) inches, between about 0.5 inches (~12.7 millimeters) and about 0.025 inches (~0.635 millimeters), or less than about 0.025 inches (~0.635 millimeters). In some preferred embodiments, the wall thickness varies along some portion of the length of the α-β titanium tube. For example, the formed α-β titanium tube can have a wall thickness at one or more positions along the length of the α-β titanium tube that is unequal to the wall thickness at the remaining positions along the length of the formed α-β titanium tube. In another example, the wall thickness at one or both ends of the α-β titanium tube is thicker than at other points along the length of the formed α-β titanium tube. In yet another example, the wall thickness of the formed α-β titanium tube increases or decreases along the length or one or more portions of the length of the α-β titanium tube. In especially preferred embodiments, the formed α-β titanium tube has a "dog bone" shape (i.e., the wall thickness at both ends of the α-β titanium tube is greater, though not necessarily in uniform steps, than the wall thickness at some middle portion of the length of the α-β titanium tube).

The formed α-β titanium tube can have any desired outer and inner diameter. For example, the formed α-β titanium tube can have an outer diameter of about 25 inches (~635 millimeters) or less, about 12 inches (~305 millimeters) or less, about 10 inches (~254 millimeters) or less, about 6 inches (~152 millimeters) or less and/or an inner diameter of about 2 inches (~51 millimeters) or less, about 4 inches (~102 millimeters) or less, about 5 inches (~127 millimeters) or less, or about 10 inches (~254 millimeters) or less. Preferably, the formed α-β titanium tube has an outer diameter in the range of between about 1 and about 8 inches (~25 to ~203 millimeters). In some embodiments, the α-β titanium tube has an outer diameter of about 2.5 inches (~64 millimeters) or greater. In further embodiments, the outer diameter is about 0.25 inches (~6 millimeters) or greater.

In some embodiments of the invention, the step of flowforming the α-β titanium preform hollow to form an α-β titanium tube includes one or more forward flowforming operations or processes. In other embodiments of the invention, the step of flowforming the α-β titanium preform hollow includes one or more reverse flowforming operations or processes. In further embodiments of the invention, the step of flowforming the α-β titanium tube includes one or more reverse flowforming operations or processes and one or more forward flowforming operations or processes.

In various embodiments, the flowformed α-β titanium tube has two open ends or one open end and a closed or partially closed end.

Annealing

In some embodiments of the invention, one or more optional annealing steps are performed. For example, the α-β titanium preform hollow can be annealed before the flowforming step and/or the α-β titanium tube can be annealed after it is flowformed.

Optionally, one or more annealing steps can be performed between flowforming steps. For example, an α-β titanium tube can be subjected to one or more flowforming steps to create a partially flowformed α-β titanium tube and then the partially flowformed α-β titanium tube is annealed. The annealed partially flowformed α-β titanium tube can then be flowformed into a fully flowformed α-β titanium tube. In some embodiments, the entire flowforming process is interspersed with a plurality of annealing steps.

The precise temperatures at which the annealing steps are conducted is dependent upon the needs of a given application and the exact composition of the titanium alloy. For some alloys, the annealing steps are preferably conducted at temperatures in the range of between 1,100° F. and about 1,500° F. More preferably, the annealing steps are conducted at a temperature in the range of between 1,150° F. and about 1,450° F. The precise length of an annealing step can also vary with the needs of a given application and the exact composition of the titanium alloy being annealed. For some alloys, the annealing steps are preferably conducted for up to about 8 hours.

Machining

In some embodiments of the invention, one or more optional machining steps are performed. For example, the α-β titanium preform hollow can be machined before the flowforming step. Such optional machining steps are useful for ensuring the α-β titanium preform hollow will have dimensions sufficient to properly fit onto a mandrel of a flowforming machine (e.g., a predetermined inner diameter over the length or some portion of the length of the preform). Optionally, the preform hollow is machined to produce a predetermined outer diameter over the length or some portion of the length of the preform. A α-β titanium preform that does not properly fit onto the mandrel may result in cracking of the preform and/or damage to the flowforming mandrel and/or machine. Preferably, the α-β titanium preform is machined in order to produce an α-β titanium preform with a concentric inner and outer diameter that helps to result in a concentrically even α-β titanium tube. Machining the α-β titanium preform can also be useful for ensuring the α-β titanium tube has desirable dimensions or a desirable volume. In another embodiment, the α-β titanium tube that is formed is optionally machined following the flow forming step(s).

Post-Flowforming Processing

Once the flowforming step or steps have been completed, the titanium alloy tube can be subjected to additional processing methods or steps. In some embodiments of the invention, the titanium alloy tube can be subjected to one or more annealing processes (as described above). In further embodiments of the invention, the titanium alloy tube may be subjected to one or more heat treating processes. For example, the titanium alloy can be heat treated at a temperature in the range of about 800° F. to about 2,000° F. Such heat treatment can be used to alter the strength of the titanium alloy tubes.

This invention also encompasses α-β titanium alloy tubes that are formed by methods of this invention. The α-β titanium alloy tubes of this invention comprise a metal having unique metallurgical structures and/or unique crystallographic structures. Due to the unique metallurgical structures and/or crystallographic structures, the tubes of this invention often have unique and advantageous metallurgical properties (e.g., superior biaxial strength, superior hoop strength, and/or finer and more consistent grain structures compared to tubes formed by prior art methods).

Figure 3:
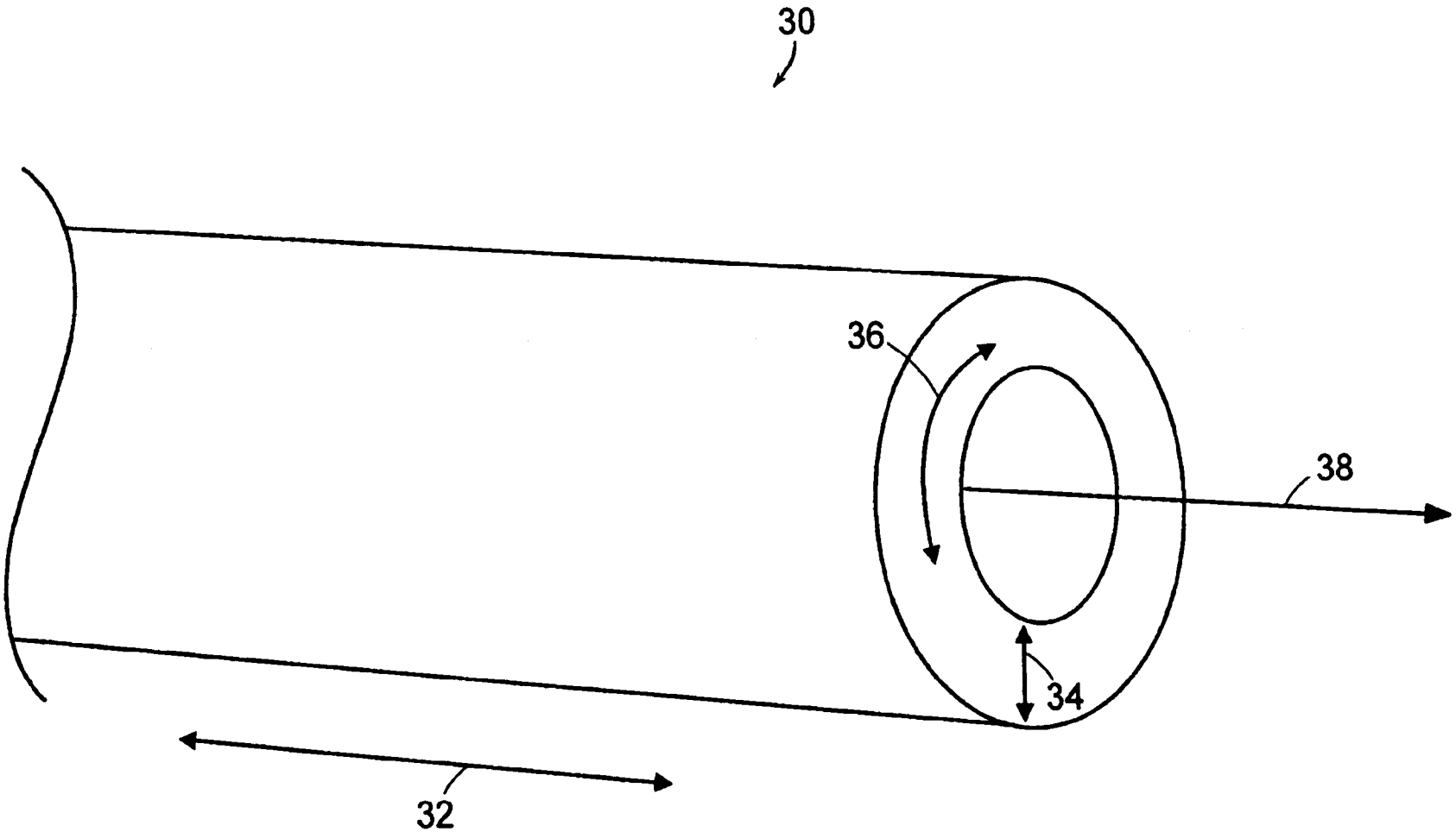
FIG. 3 graphically illustrates examples of orientations used to describe crystallographic and grain structures of metallic tubes.

Generally, the crystallographic and grain structures of metallic tubes are described using three orientations, including a longitudinal orientation, a radial orientation, and a circumferential orientation. FIG. 3 graphically illustrates examples of such orientations, including longitudinal orientation 32, radial orientation 34, and circumferential orientation 36, all useful for describing crystallographic texture and grain structures of a metallic tube 30 having major axis 38. Longitudinal orientation 32 runs along a surface of the tube or in the tube and is parallel to major axis 38. Radial orientation 34 lies along a line that emanates from the center of the tube and is normal to major axis 38 and longitudinal orientations (e.g., longitudinal orientation 32). Circumferential orientation 36 runs along a surface of the tube or in the tube, and lies in a circumference of the tube wall (i.e., along a curved line that both lies in a plane normal to major axis 38 and is normal to radial orientations such as, for example, radial orientation 34).

In some embodiments, portions of the tubes of this invention have a unique grain orientation. For example, the portions of α-β titanium alloy tubes made of titanium having an hexagonal closed-packed (hcp) crystal structure and formed using a prior art extrusion process will typically exhibit grains that are equiaxed. That is, the grains of the α phase portions of an α-β titanium alloy tube formed using a prior art extrusion process will typically be uniform in shape in all three orientations. The portions of α-β titanium alloy tubes made of titanium having an hcp crystal structure and formed in accordance with the methods of this invention, however, generally exhibit grains that are shaped like an "elongated pancake," with the length of the grains relatively flattened in the radial orientation and relatively elongated in both the circumferential and longitudinal orientations, with the elongation being more pronounced in the longitudinal orientation than the circumferential orientation. That is, the grains of the α phase portions of the α-β titanium alloy tubes of this invention have grains that are:

1. Elongated substantially in the longitudinal orientation;
2. Elongated in the circumferential orientation, although not to the same degree as the elongation in the longitudinal orientation; and
3. Flattened or shortened in the radial orientation.

In some embodiments, portions of the tubes of this invention comprise a titanium metal having an average grain size that is smaller or finer than that found in tubes made by prior art methods. For example, portions of α-β titanium alloy tubes made of titanium having an hcp crystal structure and formed using a prior art extrusion process typically have equiaxed grains that are about No. 8 is size on the ASTM E112 scale or larger in size. That is, the grains of the α phase portions of an α-β titanium alloy tube formed using a prior art extrusion process will typically be about No. 8 or larger in size on the ASTM E112 scale. The portions of α-β titanium alloy tubes made of titanium having an hcp crystal structure and formed in accordance with the methods of this invention, however, generally exhibits grains that are smaller or finer (e.g., No. 11, 12, or finer on the ASTM E112 scale) along the radial orientation. Hence, the tubes of this invention comprise portions having a finer grain size. In some embodiments, the α phase portion of the tubes of this invention have an average grain length in the radial orientation that is no greater than about 0.00025 inches, preferably no greater than about 0.0001 inches.

In some embodiments, portions of the tubes of this invention have a unique crystallographic texture compared to that of tubes formed with prior art methods. For example, the portions of α-β titanium alloy tubes made of titanium having an hcp crystal structure and formed using a prior art extrusion process will typically exhibit a crystallographic texture having basal planes orientated or stacked in a longitudinal direction. That is, the crystallographic texture of the α phase portions of an α-β titanium alloy tube formed using a prior art extrusion process will typically exhibit a crystallographic texture where:

1. The c-axes of the hexagonal cells are collinear to lines running in longitudinal orientations, normal to lines running in radial orientations, and normal to lines running in circumferential orientations; and
2. The basal planes are normal to lines running in longitudinal orientations, coplanar with lines running in radial orientations, and coplanar with lines running in circumferential orientations.

Figure 4:
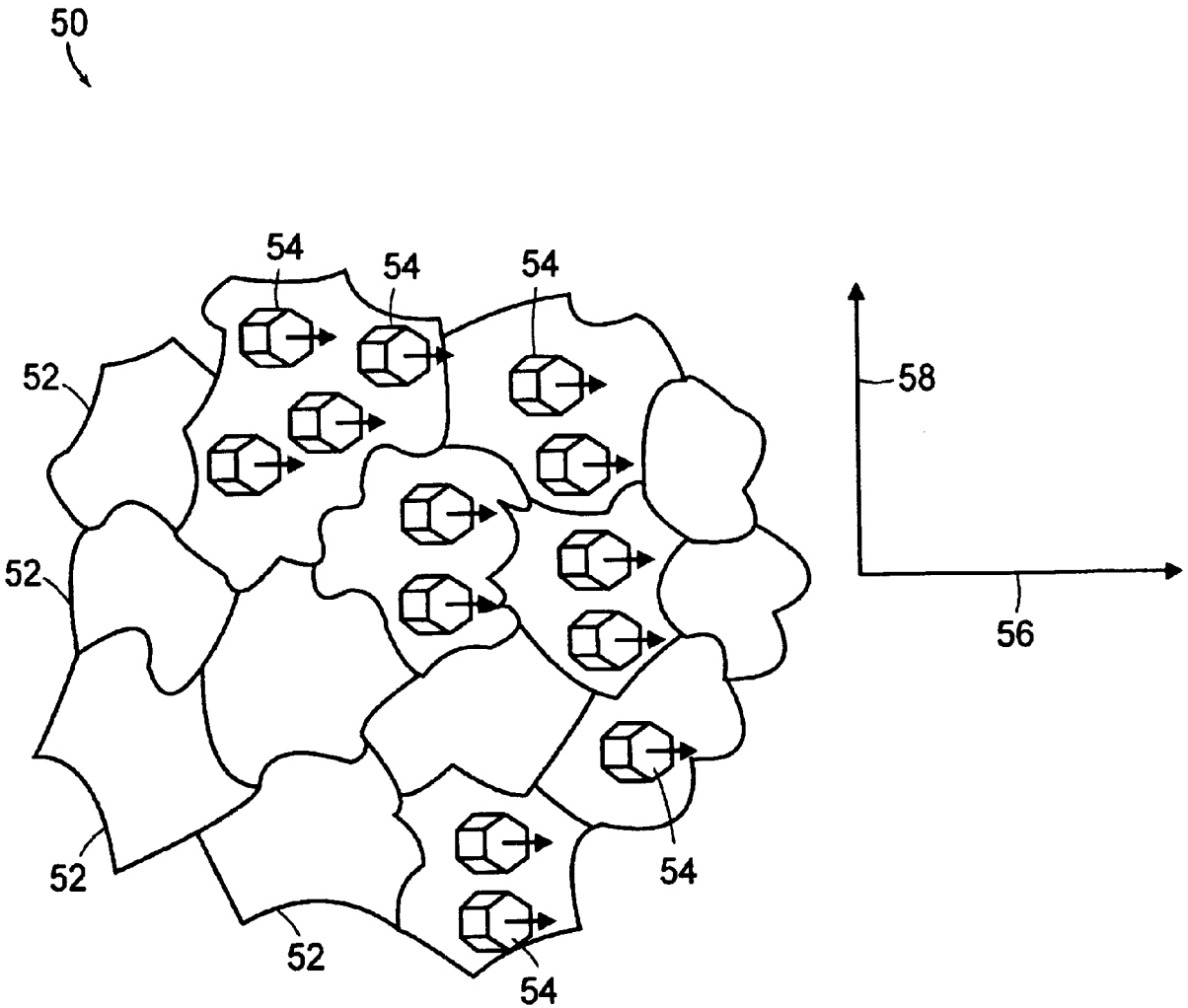
FIG. 4 illustrates the crystallographic orientation of a portion of α-β titanium alloy tubes made of titanium having an hcp crystal structure and formed with a prior art extrusion process.

FIG. 4 illustrates the crystallographic orientation of a portion of an α-β titanium alloy tube made of titanium having an hcp crystal structure and formed with a prior art extrusion process. Portion 50 includes a plurality of equiaxed grains 52. Grains 54 include hexagonal crystal cells 54. The c-axes of cells 54 are collinear or parallel with lines running in longitudinal orientation 56. The basal planes of cells 54 are coplanar or lie in planes parallel to radial orientation 58. (The relative size of the hexagonal cells in FIG. 4 has been exaggerated for clarity.)

The portions of α-β titanium alloy tubes made of titanium having an hcp crystal structure and formed in accordance with the methods of this invention, however, generally exhibit a crystallographic texture having basal planes orientated or stacked in a radial direction. That is, the α phase portions of the α-β titanium alloy tubes of this invention have a crystallographic texture where:

1. The c-axes of the hexagonal cells are normal to lines running in longitudinal orientations, collinear to lines running in radial orientations, and normal to lines running in circumferential orientations; and
2. The basal planes are coplanar with lines running in longitudinal orientations, normal to lines running in radial orientations, and coplanar with lines running in circumferential orientations.

Figure 5:
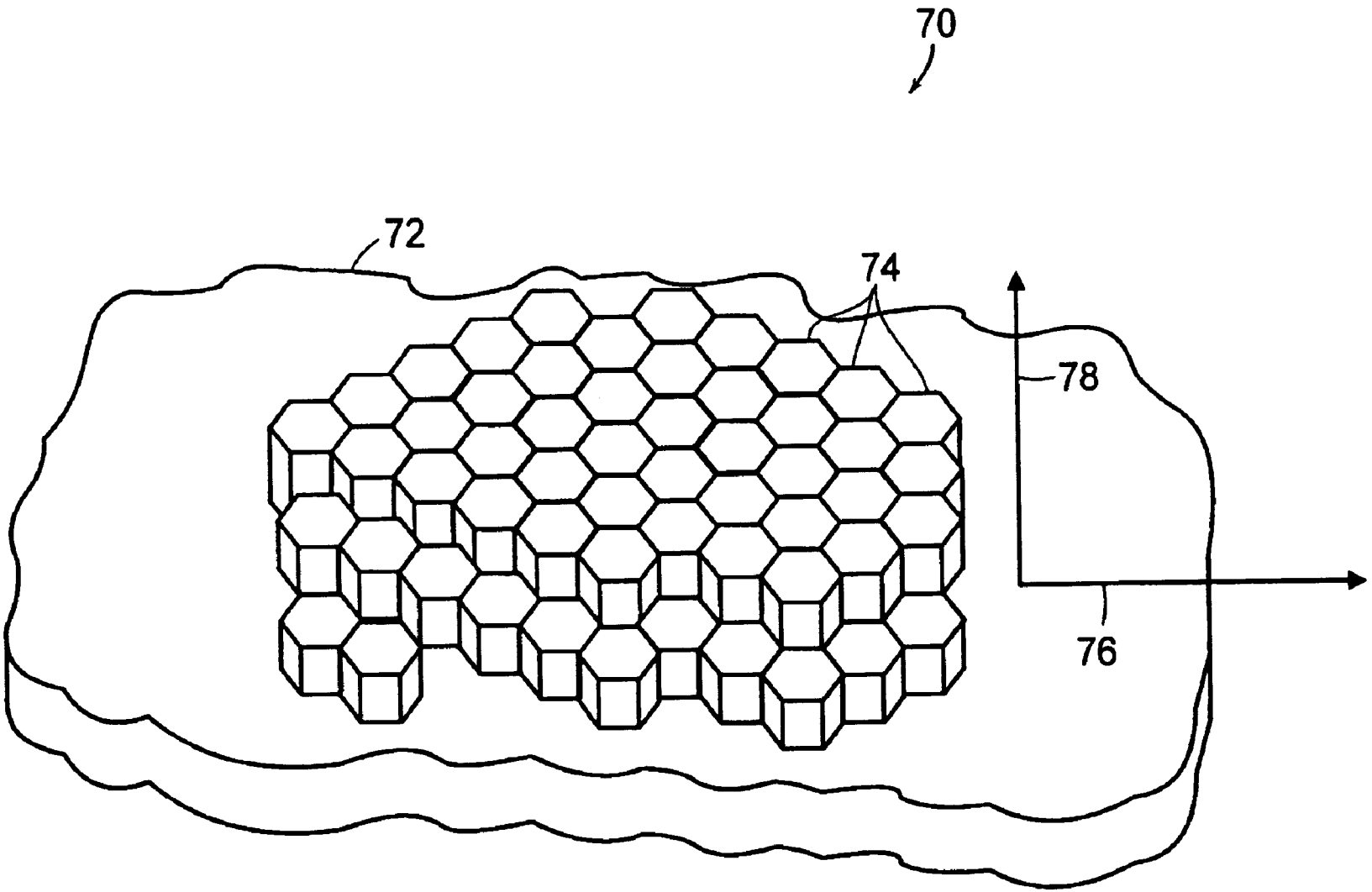
FIG. 5 illustrates the crystallographic orientation of a portion of α-β titanium alloy tube of the present invention.

FIG. 5 illustrates the crystallographic orientation of a portion of an α-β titanium alloy tube of the present invention made of titanium having an hcp crystal structure and formed with a method of the invention. Portion 70 includes an "elongated pancake" shaped grain 72 from an α phase portion of a tube of the present invention. Grain 72 includes hexagonal crystal cells 74. The c-axes of cells 74 are normal to lines running in longitudinal orientation 76. The basal planes of cells 74 are normal to lines that are collinear or parallel to radial orientation 78. (The relative size of the hexagonal cells in FIGS. 6 and 7 have been exaggerated for clarity.)

In one embodiment, this invention features an α-β titanium alloy tube comprising α phase titanium portions and β phase titanium portions. The α phase titanium portions including hexagonal crystal cells having basal planes aligned in a radial direction.

What is claimed is:

1. A method of manufacturing an α-β titanium alloy tube, the method comprising the steps of:

a) producing an α-β titanium alloy preform hollow by hot-working a titanium alloy workpiece at a temperature below the β-transus temperature of the workpiece and above the recrystallization temperature of the workpiece so that the preform hollow is at least 10% by volume alpha phase titanium; and b) flowforming the preform hollow at a temperature below the recrystallization temperature of the hollow, thereby forming an α-β titanium alloy tube.

2. The method of claim 1, wherein the step of producing the preform hollow includes annealing the preform hollow.

3. The method of claim 2, wherein the preform hollow is annealed at a temperature of between about 1,100° F. and about 1,500° F.

4. The method of claim 1, further including a step of machining the preform hollow.

5. The method of claim 1, wherein the preform hollow is at least 30% by volume alpha phase titanium.

6. The method of claim 1, wherein the preform hollow has an average grain size of 1 or finer according to ASTM standards.

7. The method of claim 6, wherein the preform hollow has an average grain size of 4 or finer according to ASTM standards.

8. The method of claim 1, wherein the step of flowforming the preform hollow includes at least two flowform passes.

9. The method of claim 8, wherein the flowforming passes are interspersed with at least one annealing step.

10. The method of claim 1, wherein the step of flowforming the preform hollow includes a reverse flowforming operation.

11. The method of claim 1, wherein the step of flowforming the preform hollow includes a forward flowforming operation.

12. The method of claim 1, wherein the preform hollow that is formed has one open end.

13. The method of claim 1, wherein the preform hollow that is formed has two open ends.

14. The method of claim 1, wherein the α-β titanium alloy tube that is formed has one open end and one fully closed or semi-closed end.

15. The method of claim 1, wherein the α-β titanium alloy tube that is formed has two open ends.

16. The method of claim 1, wherein the α-β titanium alloy tube that is formed also includes at least one metal selected from the group consisting of aluminum, carbon, cobalt, chromium, copper, gallium, germanium, hydrogen, iron, manganese, molybdenum, nickel, nitrogen, oxygen, silicon, tin, vanadium, zirconium and combinations thereof.

17. The method of claim 1, wherein the α-β titanium alloy tube that is formed is made of one of the members of the group consisting of Ti-6Al-4V, Ti-6Al-4V ELI, Ti-3Al-2.5V, Ti-6Al-2Sn-4Zr-2Mo, Ti-6Al-2Sn-4Zr-6Mo, and Ti-4Al-2.5V.

18. The method of claim 1, wherein the α-β titanium alloy tube that is formed has a wall thickness in the range of between about 0.008 inches and about 0.750 inches.

19. The method of claim 1, wherein the α-β titanium alloy tube that is formed has an outside diameter in the range of between about 0.250 inches and about 25.0 inches.

20. The method of claim 1, wherein the α-β titanium alloy tube that is formed has a length of at least about 3 inches.

21. The method of claim 1, wherein the step of producing the preform hollow includes at least one casting process.

22. The method of claim 1, wherein the step of producing the preform hollow includes at least one cogging process.

23. The method of claim 1, wherein the step of producing the preform hollow includes at least one extrusion process.

24. The method of claim 23, wherein the step of producing the preform hollow includes at least one of the extrusion processes selected from the group consisting of a backward extrusion process, a direct extrusion process, a forward extrusion process, an impact extrusion process, and an indirect extrusion process.

25. The method of claim 1, wherein the step of producing the preform hollow includes extruding a metal that is in at least one of the forms selected from the group consisting of a bar, a billet, a consolidated metal powder, and a metal casting.

26. The method of claim 25, wherein the step of producing the preform hollow further includes at least one annealing process conducted at a temperature greater than 1,100° F. following the extrusion process.

27. The method of claim 1, wherein the step of producing the preform hollow includes at least one forging process.

28. The method of claim 27, wherein the step of producing the preform hollow further includes at least one annealing process conducted at a temperature greater than 1,100° F. following the forging process.

29. The method of claim 1, wherein the step of producing the preform hollow includes machining a hot-rolled bar.

30. The method of claim 1, wherein the step of producing the preform hollow includes at least one piercing process.

31. The method of claim 1, wherein the step of producing the preform hollow includes at least one pilgering process.

32. The method of claim 1, wherein the step of producing the preform hollow includes hot isostatic pressing at least a portion of metal powder.

33. The method of claim 1, wherein the step of producing the preform hollow includes at least one rolling process.

34. The method of claim 1, wherein the step of producing the preform hollow includes at least one swaging or GFM process that reduces the size of a forging stock.

35. The method of claim 1, wherein the titanium alloy workpiece has an α-β phase structure prior to the hot working step.

36. The method of claim 1, wherein the step of hot working the titanium alloy workpiece forms an α-β phase structure in the titanium alloy workpiece.

37. The method of claim 1, wherein the preform hollow is flowformed at a temperature below the recrystallization temperature of the α-β titanium alloy.

38. The method of claim 1, wherein the flowforming step is conducted at room temperature.

39. The method of claim 1, wherein the preform hollow further includes a second metal layer.

* * * * *

UNITED STATES PATENT AND TRADEMARK OFFICE

CERTIFICATE OF CORRECTION

PATENT NO. : 7,601,232 B2
APPLICATION NO. : 11/004629
DATED : October 13, 2009
INVENTOR(S) : Fonte et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 836 days.

Signed and Sealed this

Fifth Day of October, 2010

David J. Kappos

David J. Kappos
*Director of the United States Patent and Trademark Office*